US007896678B2

(12) United States Patent
Zhang

(10) Patent No.: US 7,896,678 B2
(45) Date of Patent: Mar. 1, 2011

(54) CONTACT TERMINAL HAVING RECEIVING ARMS ARRANGED TO PROVIDE ROBUST RECEIVING SPACE THEREBETWEEN

(75) Inventor: Jie-Feng Zhang, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/538,803

(22) Filed: Aug. 10, 2009

(65) Prior Publication Data

US 2010/0035488 A1 Feb. 11, 2010

(30) Foreign Application Priority Data

Aug. 10, 2008 (CN) ..... 2008 2 0041236

(51) Int. Cl.
*H01R 4/50* (2006.01)

(52) U.S. Cl. ..... 439/342; 439/857

(58) Field of Classification Search ..... 439/342, 439/857, 856

See application file for complete search history.

(56) References Cited

U.S. PATENT DOCUMENTS

| | | | | |
|---|---|---|---|---|
| 6,443,752 | B1 * | 9/2002 | Kosawa | 439/342 |
| 6,485,313 | B1 * | 11/2002 | Lu et al. | 439/83 |
| 6,830,471 | B2 * | 12/2004 | Okita et al. | 439/342 |
| 6,908,328 | B2 * | 6/2005 | Lei et al. | 439/342 |
| 6,979,219 | B2 * | 12/2005 | Scholz | 439/342 |
| 7,303,421 | B2 * | 12/2007 | Liao | 439/342 |
| 7,674,125 | B2 * | 3/2010 | Chien et al. | 439/342 |
| 7,699,638 | B2 * | 4/2010 | Zhang | 439/342 |
| 2004/0009694 | A1 * | 1/2004 | Lai | 439/342 |
| 2005/0250367 | A1 * | 11/2005 | Scholz | 439/342 |
| 2007/0059966 | A1 * | 3/2007 | Liao | 439/342 |

FOREIGN PATENT DOCUMENTS

| | | |
|---|---|---|
| TW | 330663 | 4/2008 |

* cited by examiner

*Primary Examiner* — Gary F. Paumen
(74) *Attorney, Agent, or Firm* — Andrew C. Cheng; Wei Te Chung; Ming Chieh Chang

(57) ABSTRACT

An electrical contact terminal used for an electrical connector, includes a planar vertical base portion (20) having a front main face and a pair of lateral side edges, a solder portion (21) extending downwardly from the base portion, a U-shaped resilient arm (29) connecting to one lateral side edge of the base portion. The U-shaped resilient arm has a pair of contact portions defining therebetween a slot extending along a direction parallel to the front main face for receiving a complementary pin.

16 Claims, 3 Drawing Sheets

CONTACT TERMINAL HAVING RECEIVING ARMS ARRANGED TO PROVIDE ROBUST RECEIVING SPACE THEREBETWEEN

BACKGROUND OF THE INVENTION

1. Field of the Invention

The present invention generally relates to an electrical contact terminal, and more particularly to an electrical contact terminal used in a socket connector for electrically connecting a chip module, such as a Central Processing Unit (CPU), with a printed circuit board (PCB).

2. Description of Related Art

Taiwanese Utility Pat No. 330663 issued to Zeng on Apr. 11, 2008 discloses an electrical terminal. The electrical terminal comprises a base, a solder portion extending downwardly and forwardly from the base, a connecting portion laterally bent from one side of the base, a first spring arm and a second spring arm. The first spring arm extends upwardly from the upper side of the connecting portion, and the second spring arm extends downwardly from the lower side of the connecting portion and then bent inversely and then extends upwardly. A pair of contact portions are respectively formed at distal ends of the spring portions and a pair of palms extend forwardly and outwardly from the contact portions. The pair of palms define a receiving space therebetween for guiding the insertion of the pin legs of the CPU. The first and the second spring arms define a U-shaped resilient arm on front of the base.

However, the U-shaped resilient arm is located on front of the base which will occupy a part of space of the receiving space such that the pin leg of the CPU will be difficult to insert into the receiving space.

Therefore, it is desired to provide an improved electrical terminal to solve the problems mentioned above.

BRIEF SUMMARY OF THE INVENTION

Accordingly, an object of the present invention is to provide an electrical contact terminal defining a larger space for the pin of the CPU to insert easily.

In order to achieve the object set forth, an electrical contact terminal made in accordance with the present invention includes a base portion having a main surface with side edges. The base portion includes an enlarged retaining portion with a mounting extending downward therefrom. An U-shaped contact engaging arms extends from a side edge of the base portion and defines a receiving space therebetween for receiving a pin leg of a CPU therebetween.

Other objects, advantages and novel features of the invention will become more apparent from the following detailed description of the present embodiment when taken in conjunction with the accompanying drawings.

DETAILED DESCRIPTION OF THE INVENTION

Reference will now be made to the figures to describe the present invention in detail.

Figure 1:
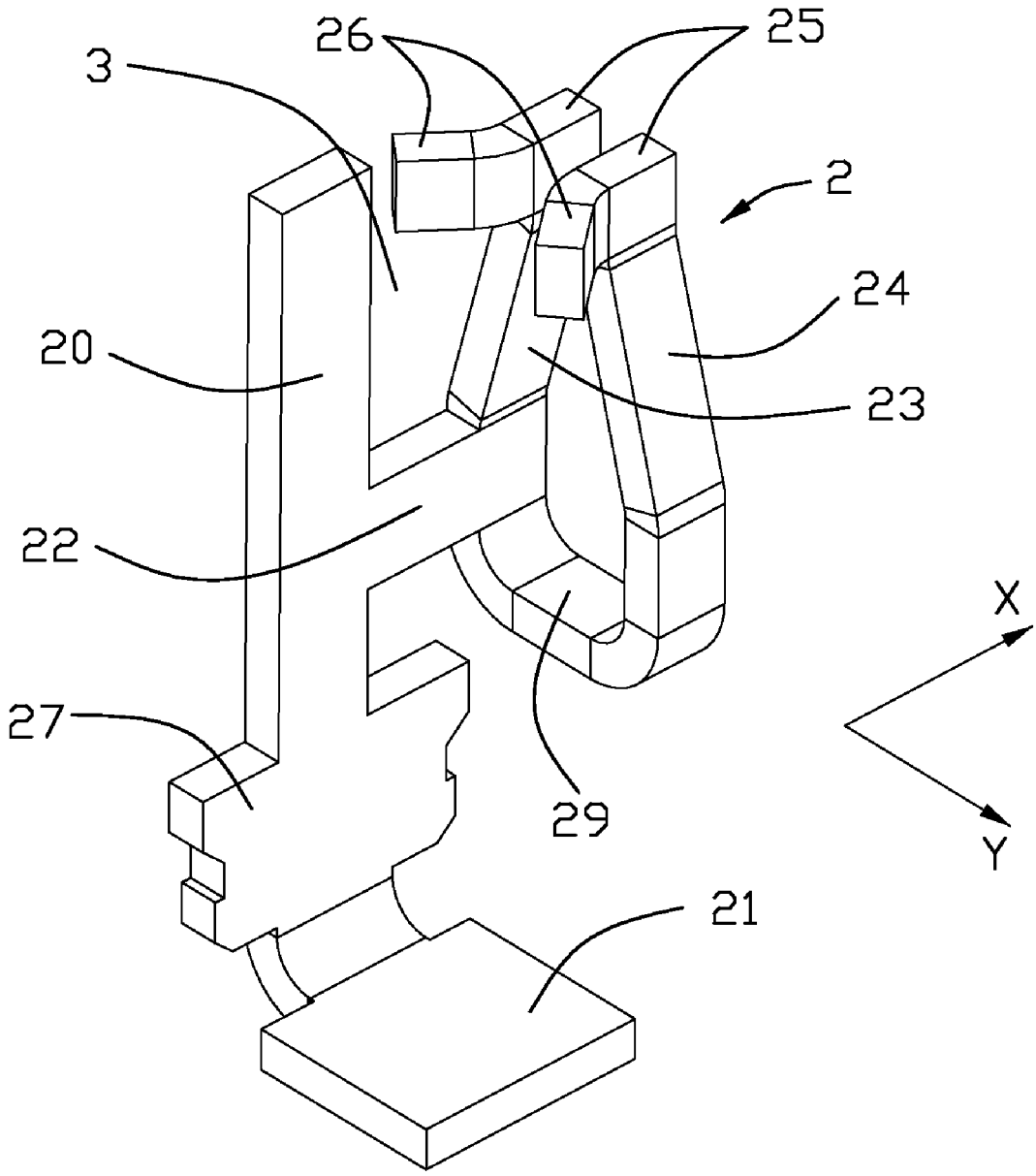
FIG. 1 is a perspective view of an electrical contact terminal.

Referring to FIG. 1, an electrical contact terminal 2 comprises a planar vertical base portion 20 defining a front main face and a pair of lateral side edges, a solder portion 21 extending from a bottom end of the base portion 20 and a U-shaped resilient arm 29 integrally connected to one side of the base portion 20. The base portion 20 forms a plurality of fastening members 27 for retaining the electrical terminal 2. The front main face extends along an X direction, while the bottom of the U-shaped arm 29 defines a plane extends along the Y direction which is perpendicular to the X direction. A connecting arm 22 extends from one lateral side edge of the planar base portion 20 along the X direction and connects the planar base portion 20 with the U-shaped arm 29.

The U-shaped resilient arm 29 comprises a first flexible arm 23 extending upwardly from the upper side of the connecting arm 22 and a second flexible arm 24 extending downwardly from the lower side of the connecting arm 22, and then, bending reversely to extend upwardly. A pair of contact portions 25 is defined on two ends of the first and the second flexible arms 23,24 respectively. A pair of guide portions 26 extends outwardly toward the base portion 20 from the pair of contact portions 25. The pair of guide portions 26 defines a trumpet-shaped structure to guide a pin leg (not shown) of a CPU (not shown) to electrically connect with the contact portions 25. A larger space 3 is defined in the front of the base portion 20 for communicating with the trumpet-shaped structure of the guide portions 26. The U-shaped resilient arm 29 is integrated with one lateral side edge of the base portion 20 to provide enough space to define the larger space 3 in front of the base portion 20. The contact portions 25 define therebetween a slot (not labeled) for receiving the complementary pin leg. The slot extends along X direction and parallel to the front main face.

Figure 2:
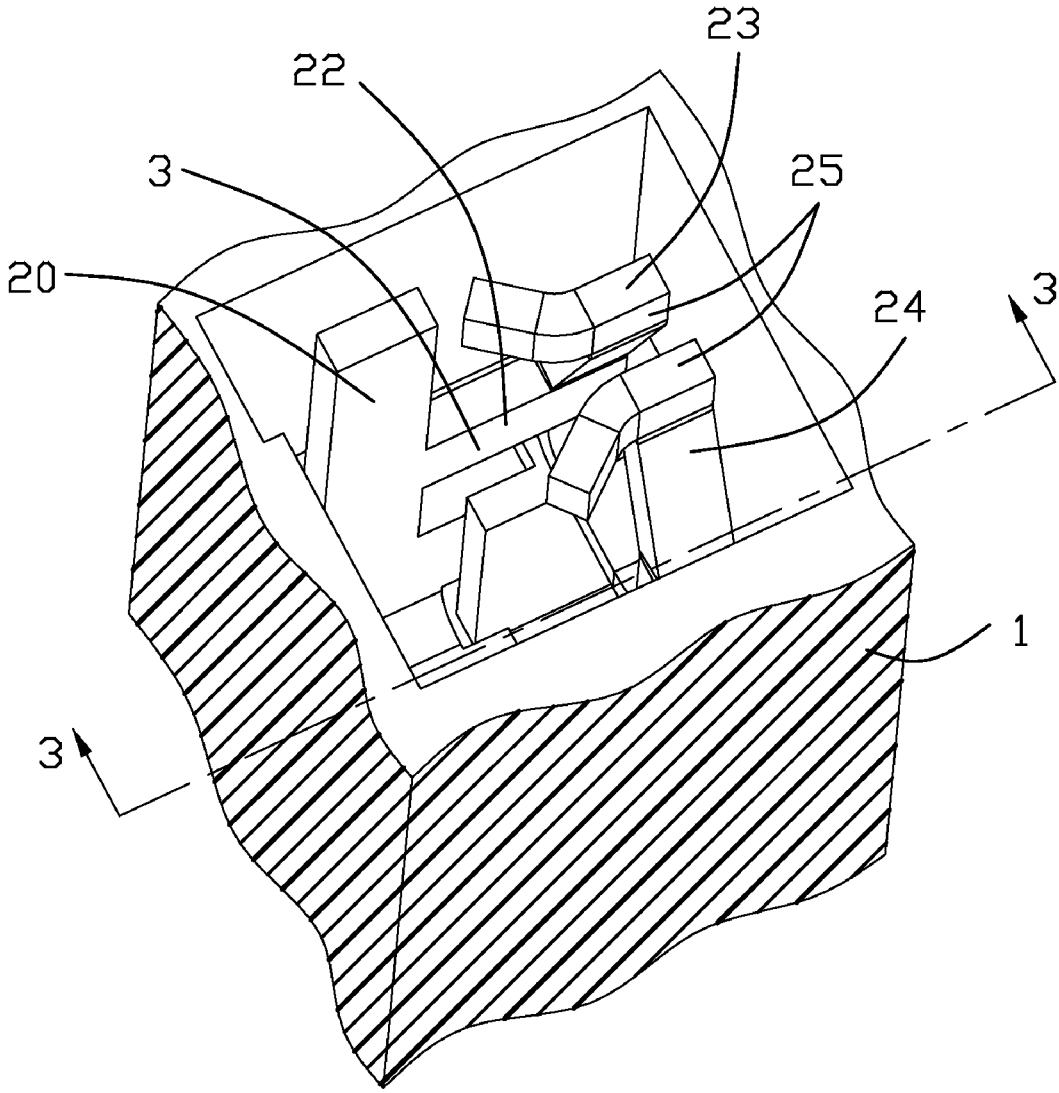
FIG. 2 is a perspective view of the electrical contact terminal assembled in an insulating housing.
Figure 3:
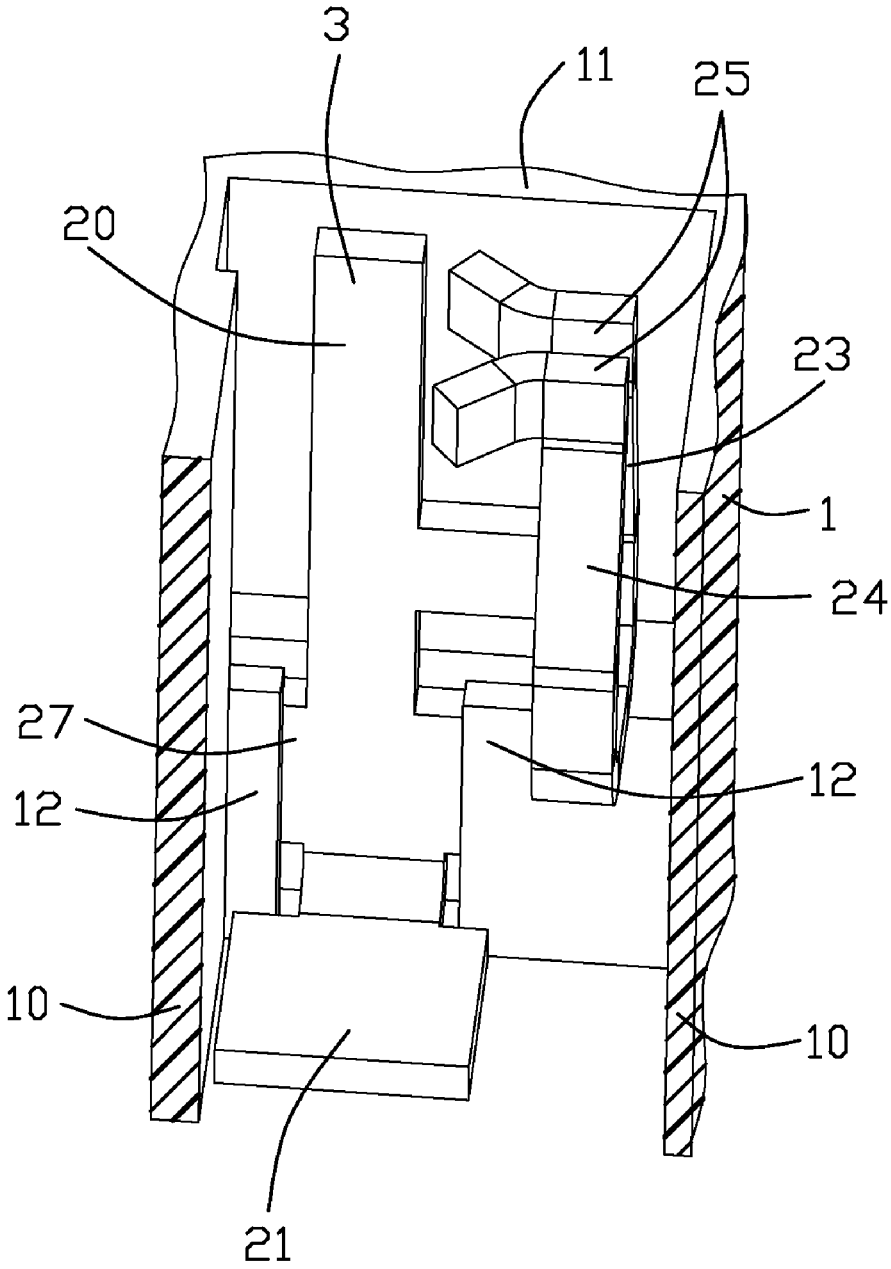
FIG. 3 is another perspective view of FIG. 2 with one side wall of the insulating housing cut along line 3-3.

Referring to FIGS. 2-3, an insulating housing 1 for receiving the terminals 2 comprises a passageway having two opposite first and second side walls 10,11. The second side wall 11 forms several fastening portions 12. The fastening members 27 of the base portion 20 interengage with the fastening portions 12 of the insulating housing 1 to retain the electrical contact terminal 2 in the insulating housing 1.

Referring to FIGS. 2-3, the electrical contact terminal 2 is securely retained in the insulating housing 1. In use, the pin leg of the CPU is inserted to the space 3 without any resistance; then, the pin is moved alone the guide portions 26 towards the pair of contact portions 25; finally, the pin leg of the CPU is tightly gripped by the contact portions 25 to ensure a good electrical performance interconnection therebetween. Because of the space 3 is large enough, the pin leg of the CPU can be inserted into the space 3 easily in assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical contact terminal used for an electrical connector, comprising:

a planar vertical base portion defining a front main face and a pair of lateral side edges;

a solder portion extending from the base portion for coupling to a solder ball and cooperating with the base portion for defining a first plane; and a U-shaped resilient arm connected to one lateral side edge of the base portion, said U-shaped resilient arm comprising a pair of contact portions defining therebetween a slot for receiving a complementary pin, said slot having an inlet facing towards the first plane.

2. The electrical contact terminal as claimed in claim 1, wherein the U-shaped resilient arm defines a second plane parallel to the first plane.

3. The electrical contact terminal as claimed in claim 2, further comprising a connecting arm extending from the planar base portion and connecting to the U-shaped resilient arm, and wherein said connecting arm extends in a third plane perpendicular to both the first plane and the second plane.

4. The electrical contact terminal as claimed in claim 3, wherein the U-shaped resilient arm comprises a first portion extending upwardly from the connecting arm and a second portion bending and then extending upwardly from the connecting arm.

5. The electrical contact terminal as claimed in claim 4, wherein the pair of contact portions are arranged on ends of the first and second portions.

6. The electrical contact terminal as claimed in claim 5, wherein the pair of contact portions defines a pair of guide portions extending outwardly towards the first plane.

7. The electrical contact terminal as claimed in claim 1, wherein a space is defined in front of the base portion above the solder portion, and the inlet of the slot has a trumpet-shaped structure communicating with the space.

8. An electrical connector for electrically connecting a Central Processing Unit (CPU) with a Printed Circuit Board (PCB), comprising:

an insulating housing defining a least one passageway;

at least one conductive terminal received in the corresponding passageway respectively, and including:

a planar base defining a first plane;

a solder portion extending perpendicularly from the base and defining a second plane; and a first and a second flexible arms connected to the base and cooperatively defining a third plane perpendicularly to both the first plane of the planar base and the second plane of the solder portion.

9. The electrical contact terminal as claimed in claim 8, wherein each passageway has two pairs of side walls and wherein the base is attached to a first wall and the first and the second flexible arms extending parallel to a second wall which is perpendicular to the first wall.

10. The electrical contact terminal as claimed in claim 9, wherein the first and the second flexible alms define a pair of contact portions arranged at two ends thereof respectively.

11. The electrical contact terminal as claimed in claim 10, wherein a pair of guide portions extends from ends of the contact portions outwardly towards a front of the base.

12. An electrical contact terminal stamped and formed from a planar metallic sheet and use with a pin of an electronic package wherein said pin is adapted to be mated with the contact terminal in a first transverse direction, and said contact terminal defines opposite first and second sides in said first transverse direction, comprising:

associated retaining base and solder pad located on said first side;

associated first flexible arm and second flexible arm located on said second side; wherein said base portion is linked to said associated first flexible arm and second flexible arm via a connection arm which extends along said first transverse direction and is essentially located between said first side and said second side in said first transverse direction, and said first flexible arm and said second flexible arm commonly define a receiving space for receiving the pin of electronic package therein under condition that the first flexible arm defines a first guide portion and a first contact portion at a first top end portion thereof, and the second flexible arm defines a second guide portion and a second contact portion at a second top end portion thereof wherein the first guide portion and the second guide portion are opposite to each other in a second transverse direction perpendicular to said first transverse direction and commonly define therebetween a space larger than that defined between the first contact portion and the second contact portion which are opposite to each other along said second transverse direction.

13. The electrical contact terminal as claimed in claim 12, wherein the first contact portion is essentially aligned with the first flexible arm while the first guide portion is not but offset therefrom in the first transverse direction.

14. The electrical contact terminal as claimed in claim 12, wherein the second contact portion is essentially aligned with the second flexible arm while the second guide portion is not but offset therefrom in the first transverse direction.

15. The electrical contact terminal as claimed in claim 12, wherein said connection portion and said base portion extend in a same vertical plane perpendicular to said second transverse direction.

16. The electrical contact terminal as claimed in claim 12, wherein the first guide portion is located between the first contact portion and the retaining base in said first transverse direction.

* * * * *